US005522609A

United States Patent [19]

Gay

[11] Patent Number: 5,522,609

[45] **Date of Patent: *Jun. 4, 1996**

[54] ADJUSTABLE SKATE BRAKE

[75] Inventor: Howard Gay, West Brookfield, Mass.

[73] Assignee: Hyde Athletic Industries, Inc., Peabody, Mass.

[ * ] Notice: The term of this patent shall not extend beyond the expiration date of Pat. No. 5,348,320.

[21] Appl. No.: 210,285

[22] Filed: Mar. 18, 1994

Related U.S. Application Data

[63] Continuation of Ser. No. 965,883, Oct. 23, 1992, Pat. No. 5,348,320.

[51] Int. Cl.[6] ..... A63C 17/14

[52] U.S. Cl. ..... 280/11.2

[58] Field of Search ..... 280/11.19, 11.2, 280/11.22, 11.23

[56] References Cited

U.S. PATENT DOCUMENTS

| | | | |
|---|---|---|---|
| D. 315,941 | 4/1991 | Olson et al. . | |
| 2,706,641 | 4/1955 | Van Horn . | |
| 3,003,776 | 10/1961 | Ware | 280/11.2 |
| 3,112,120 | 11/1963 | Ware | 280/11.2 |
| 3,868,121 | 2/1975 | Ware | 280/11.2 |
| 4,418,929 | 12/1983 | Gray | 280/11.2 |
| 5,028,058 | 7/1991 | Olson . | |
| 5,052,701 | 10/1991 | Olson . | |
| 5,067,736 | 11/1991 | Olson et al. . | |
| 5,092,614 | 3/1992 | Malewicz . | |
| 5,348,320 | 9/1994 | Gay | 280/11.22 |

*Primary Examiner*—Richard M. Camby
*Attorney, Agent, or Firm*—Wolf, Greenfield & Sacks

[57] ABSTRACT

The present invention comprises a brake having a slot formed in a support for receiving an adjusting screw which slidably secures the support to the skate. The head of the adjusting screw engages the surface of the support on one side of the slot to firmly secure the brake to the skate at the selected height above the riding surface.

7 Claims, 4 Drawing Sheets

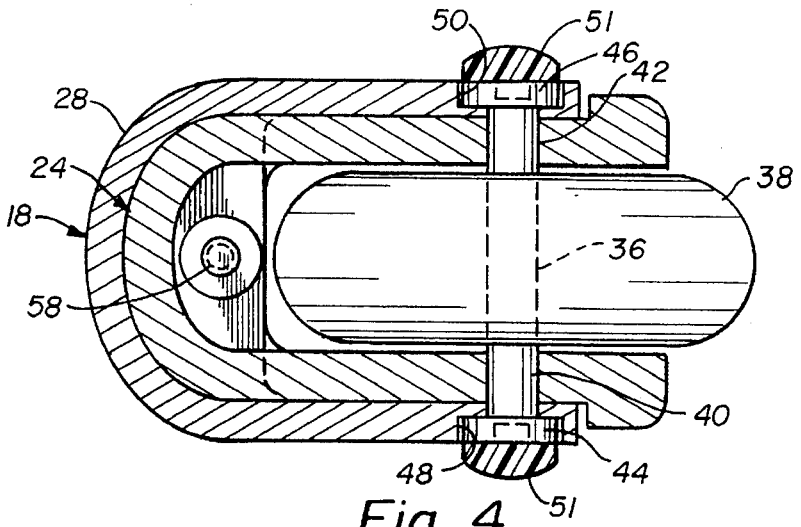
Fig. 4
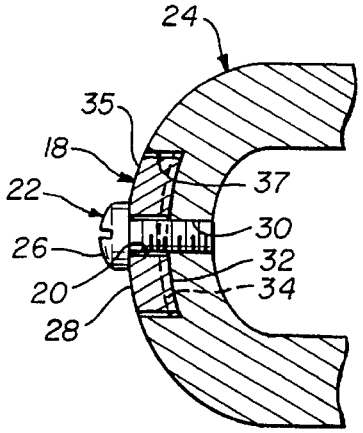
Fig. 5
Fig. 6
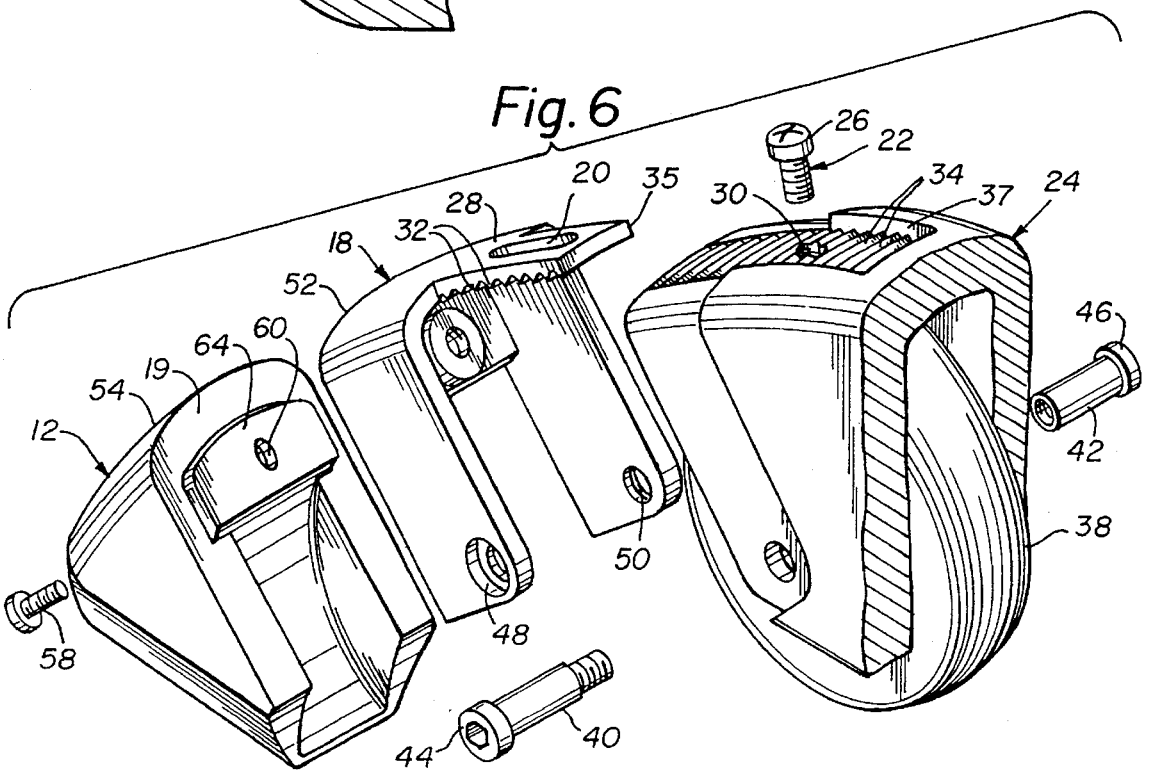

ADJUSTABLE SKATE BRAKE

This application is a continuation of application Ser. No. 07/965,883 filed on Oct. 23, 1992, now U.S. Pat. No. 5,348,320.

BACKGROUND OF THE INVENTION

Field of the Invention

This invention relates to a new and improved brake for a skate which may be adjusted to change the distance between the brake pad and the riding surface.

BACKGROUND OF THE INVENTION

In many present brake systems for both in-line skates and roller skates, a brake pad is secured to the skate by a screw. This enables to user to replace the brake pad when necessary. However, unless different size brake pads are available, the user cannot vary the distance between the brake pad and riding surface. This creates a problem for the skater as he or she gains experience. Being able to adjust the height of the brake pad for the various needs of the user, increases the useful life of the skates.

The need for an adjustable brake also exists at rental shops. Because users of various experience may rent the same pair of skates, it is important that rental shops be able to adjust the skate brakes for safe and enjoyable use by everyone. Novice users require a lower brake height for immediate engagement of the brake pad to stop forward or rearward movement. More experienced skaters usually prefer to have the brake pad further from the riding surface to perform various tricks or to just have a wide variety of skating options.

SUMMARY OF THE INVENTION

The principal object of the present invention is to provide an adjustable brake which may be selectively distanced at a variety of heights from the riding surface.

It a further object of the present invention to provide a simple means for adjusting the distance between the brake and the riding surface.

To accomplish these and other objects, a first embodiment of the present invention comprises a brake bracket having a slot for receiving an adjusting screw which slidably mounts the bracket to the skate. The head of the adjusting screw engages the surface of the brake bracket on either side of the slot to firmly secure the bracket at the desired position.

A second embodiment of the present invention includes a protrusion, extending from the skate, having a slot for receiving a screw. The screw passes through a stop external to the skate and slidably mounts the stop to the skate. To firmly secure the stop in the selection position, the screw is tightened whereby the head of the screw presses the stop against the skate.

These and other objects and features of the present invention will be better understood and appreciated from the following detailed description of two basic embodiments thereof, selected for the purpose of illustration and shown in the accompanying drawings, in which:

BRIEF DESCRIPTION OF THE DRAWINGS

FIG. 4 is a cross-sectional view taken along the lines 4—4 of FIG. 3;

FIG. 5 is cross-sectional view taken along the lines of 5—5 of FIG. 3;

FIG. 6 is an exploded view of the present invention including a portion of the in-line skate as fully depicted in FIG. 1;

DETAILED DESCRIPTION OF THE PREFERRED EMBODIMENT

Figure 1:
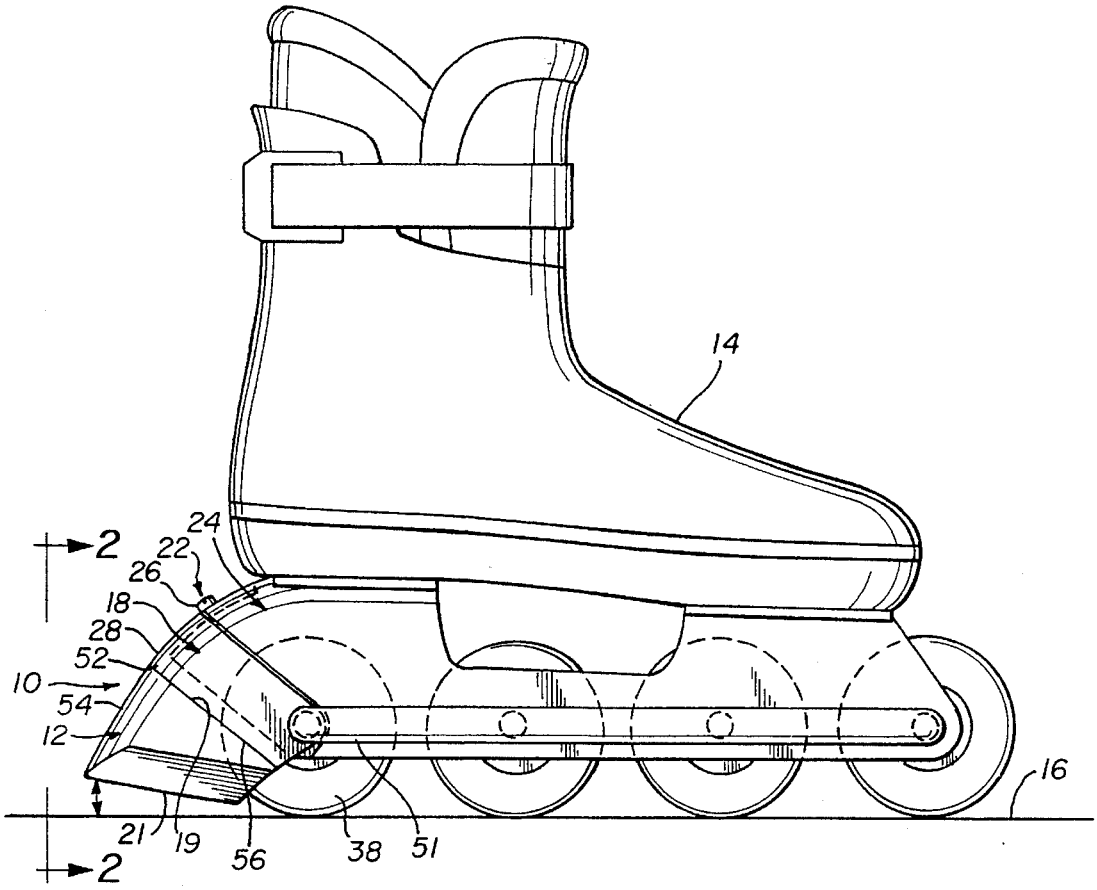
FIG. 1 is a side plan view showing the adjustable brake of the first embodiment of the present invention on an in-line skate.
Figure 2:
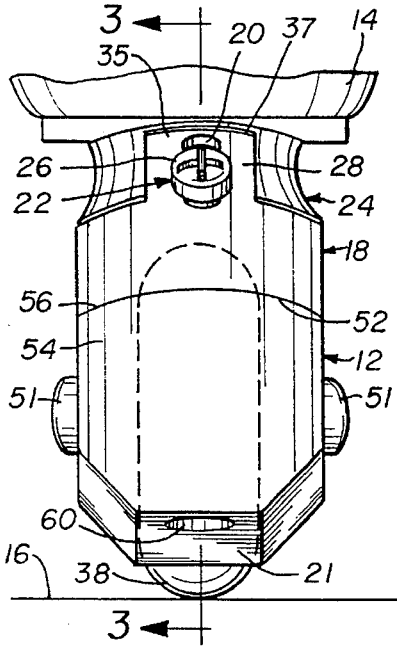
FIG. 2 is a fragmentary view taken along the lines 2—2 of FIG. 1.

FIGS. 1–6 illustrate a first embodiment of an adjustable brake 10 secured to a skate 14 above a riding surface 16. The adjustable brake 10 may be selectively positioned at various heights above the riding surface 16 according to the needs of the user.

The adjustable brake 10 consists primarily of a brake bracket 18 and a brake pad 12 secured thereto. The brake pad 12 is made of a material that will function as a brake material such as rubber or a suitable plastic. The pad 12 has a wedge-like shape with angular surfaces. One angular surface 19 engages the brake bracket 18 and the other 21 the riding surface 16. The bracket 18 is slidably mounted to the skate 14 by an adjusting screw 22 which passes through an elongated slot 20 on the bracket 18. The adjusting screw 22 further passes into a receiving hole 30 in the chassis 24 of the skate 14. The head 26 of the adjusting screw 22 engages the outer surface 28 of the bracket 18 for frictionally securing the brake 10 at the selected height. (FIG. 6)

In the first embodiment, the firm engagement of the bracket 18 to the chassis 24 is further enhanced by bracket teeth 32 positioned and sized to mate with chassis teeth 34. The bracket teeth 32 are disposed along the underside of a tongue portion 35 on the bracket 18. Also, passing through the tongue portion 35, as best see in FIG. 6, is the slot 20. The chassis 24 has a channel 37 with height and width dimensions for flush engagement of the tongue 35. The similar width of the tongue 35 and channel 37 helps guide the bracket 18 during adjustment.

The brake bracket 18 is pivotally secured to the chassis on an axle 36 which passes through the rear wheel 38, in the first embodiment, of the skate 14 (FIG. 4). The axle 36 consists of two rods 40 and 42, with rod 40 externally threaded at its reduced diameter end (FIG. 6) and rod 42 internally threaded at its inner end to receive the threaded end of rod 40. A substantial portion of the head of each rod 44 and 46 is positioned in recesses 48 and 50, respectively, on the brake bracket 18. The heads 44 and 46 may be covered by a cap 51 of vinyl or other desired material. The brake pad 12 is secured to the end 52 of the brake bracket 18 opposite the chassis 24. The outer surface 54 of the pad engages the brake bracket 18 so that the contoured outer surface 54 of the brake pad 12 and the surface 28 of the brake bracket 18 are continuous. The bracket 18 and the chassis 24 should be continuous so just only on careful inspection will the separation line 56 be noticed. (FIG. 1)

The pad 12 is secured to the brake bracket 18 by an attachment screw 58. The screw passes through one side of the brake pad 12 and into the proximal end of the bracket 18. A bore 60 passing through a substantial portion of the brake pad 12 is shaped to receive the attachment screw 58. A collar 62 in the bore 60, as shown in FIG. 3, limits the forward movement of the attachment screw 58.

Figure 3:
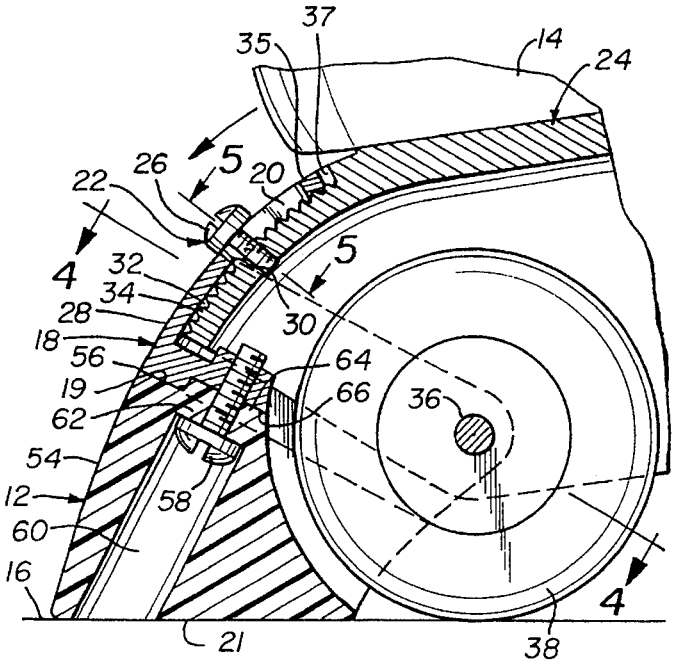
FIG. 3 is a cross-sectional view taken along the lines 3—3 of FIG. 2 with the brake engaging the riding surface.
Figure 7:
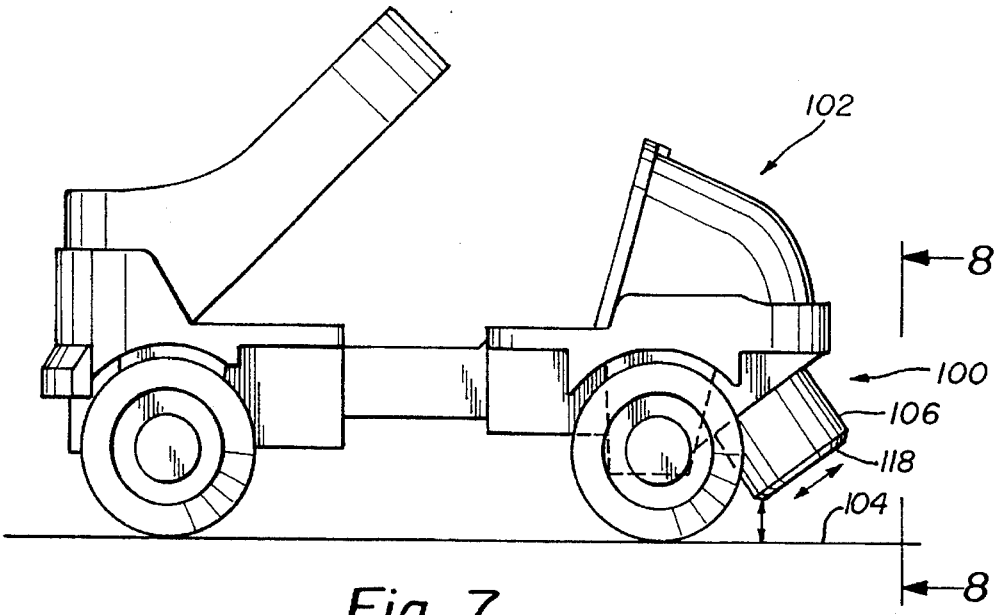
FIG. 7 is a side plan view showing the adjustable brake of the second embodiment of the present invention on a roller skate.
Figure 8:
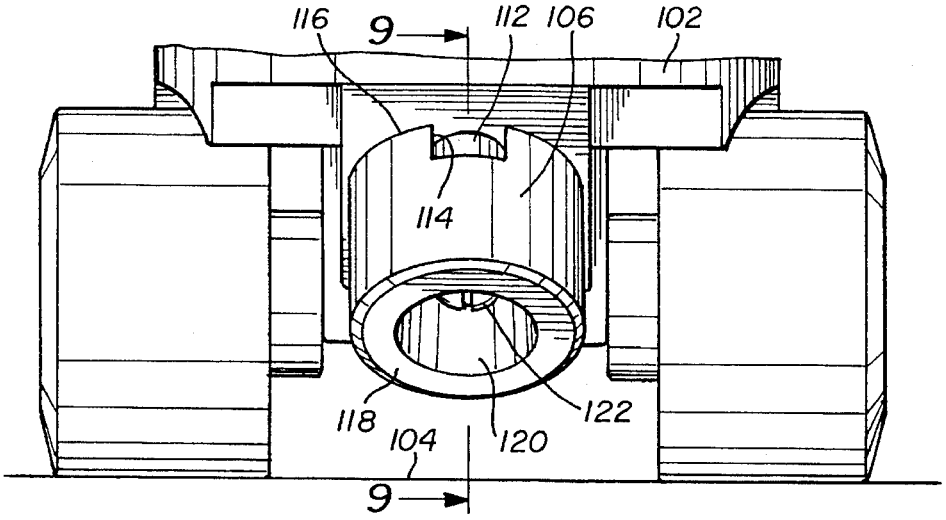
FIG. 8 is a front plan view of FIG. 7.

To further guide the attachment screw 58 into position through the bore 60 in the brake pad 12 and into the brake bracket 18, the brake pad 12 has a raised surface 64 for engaging a receiving surface 66 on the bracket 18 (FIG. 3, 6). The attachment screw 58, in the first embodiment, passes through the raised surface 64 and into the receiving surface 66.

The brake pad may be removed and replaced as it wears down from continued use. The user merely unscrews the attachment screw 58 to separate the brake pad 12 from the brake bracket 18. The new brake pad 12 is then aligned with the brake bracket 18. The alignment is guided both by the raised surface 64 of the brake pad 12 and receiving surface 66 of the brake bracket 18 as well as the continuous outer surfaces 54 and 28 of the respective elements. The attachment screw 58 is then slid into bore 60 and secured until the brake pad 12 is fixed in position on the brake bracket 18.

The position of the brake bracket 18 is adjusted by loosening the adjusting screw 22 and pivoting the brake bracket 18, on the adjusting screw 22, until the brake pad 12 is at the desired height. The adjusting screw 22 need not be removed during adjustment—just loosened until the head 26 no longer firmly engages the outer surface 28 of the bracket 18. The screw 22 may be capped as will be described in the second embodiment to prevent its complete removal. The teeth 32 and 34 interlock to form a further secured arrangement between the brake bracket 18 and the chassis 24. This helps eliminate sliding between the bracket 18 and the chassis 24.

FIGS. 7–11 illustrate a second embodiment of the present invention. The adjustable brake 100 is secured to the skate 102 above a riding surface 104. The adjustable brake 100 may be selectively positioned at various heights above the riding surface 104 according to the needs of the user.

Figure 9:
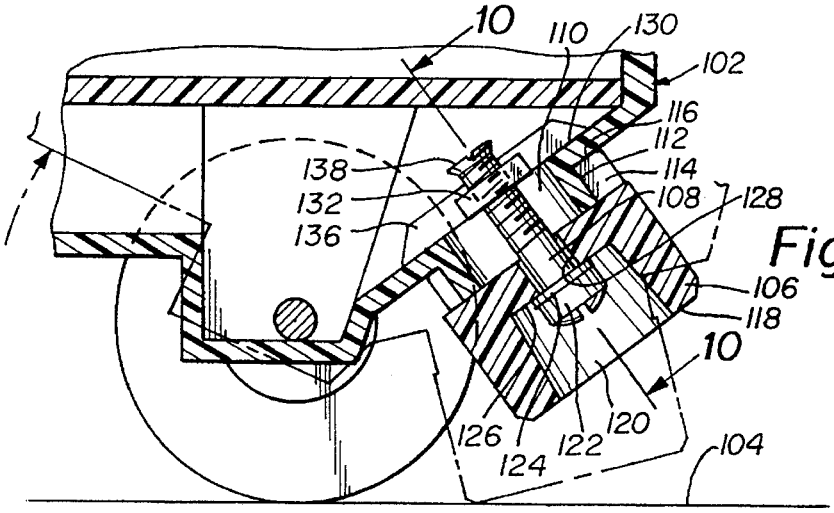
FIG. 9 is a cross-sectional view taken along the lines 9—9 of FIG. 8 wherein engagement of the brake against the riding surface is shown in dotted lines.
Figure 10:
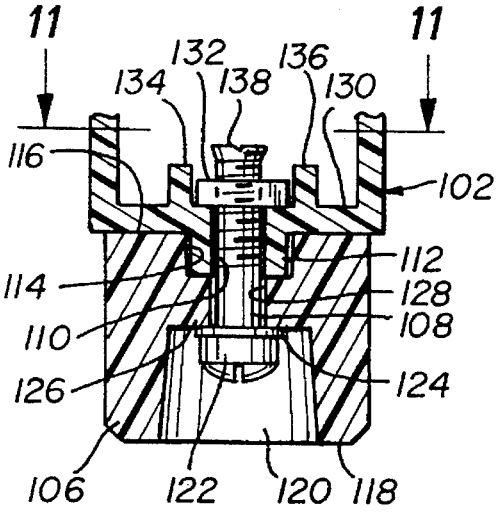
FIG. 10 is a cross-sectional view taken along the lines 10—10 of FIG. 9.
Figure 11:
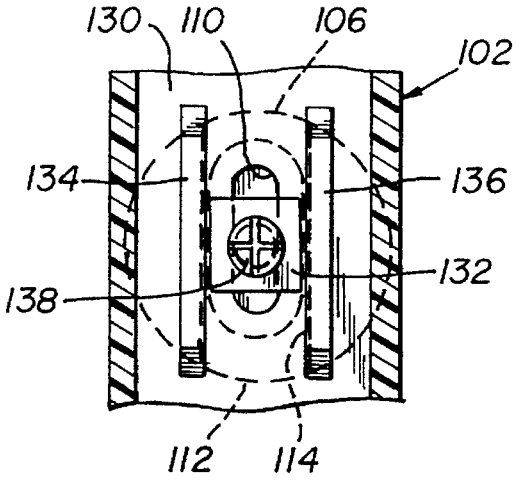
FIG. 11 is a cross-sectional view taken along the lines 11—11 of FIG. 10.

The adjustable brake 100 consists primarily of a stop or brake pad 106 slidably mounted to the skate 102 by an adjusting screw 108 which passes through a slot 110 on the skate 102. In the second embodiment, a protrusion 112 integrally formed with the skate 102 extends outwardly from the skate 102 and forms a flange surrounding the slot 110. The width of the protrusion 112 as seen in FIGS. 9–11 is substantially similar to the width of a channel 114 in the side 116 of the stop 106 facing the skate 102. This arrangement provides a guiding means for sliding the stop 106 to the desired position.

The stop 106 is made of a material that will function as a brake material such as rubber or a suitable plastic. While the stop 106 appears cylindrical in shape, any desired shape may be used. The side 118 of the stop 106 engages the riding surface 104, as shown in phantom in FIG. 9, when the brake is operated. Adjustment of this engagement is effected by an arrangement which includes a bore 120 for easy access by the user to the head 122 of the adjusting screw 108 for tightening or loosening the engagement of the stop 106 as needed.

A washer 124 is positioned between the head 122 of the adjusting screw 108 and the stop 106. The washer 124 engages a collar portion 126 of the stop 106 in the bore 120.

The adjusting screw 108 extends through a hole 128 in the stop 106 and out through side 116. The screw 108 also passes through the slot 110 in the skate 102 encircled by the protrusion 112. While the protrusion 112 acts as a guide for sliding the stop 106, the slot 110 is preferably machined to have a width similar to the diameter of the screw 108 to further limit movement of the stop 106 nonlinear with the slot direction.

The adjusting screw 108 terminates within the skate 102. The screw passes through a nut 132 on the inside 130 of the skate 102. The nut 132 rests against the inside 130 along the surface surrounding the slot 110. The nut 132 is prevented from rotating by a pair of flanges or ribs 134 and 136 extending within the skate 102. The distance between the ribs 134 and 136, as seen in FIG. 11, is substantially the same width as the nut 132.

The end 138 of the adjusting screw 108 within the skate 102 is peened to secure the nut 132, or retain the nut 132 on the screw 108' between the ribs 134 and 136.

To adjust the brake 100, one merely loosens the screw 108 and slides the stop 106 to the desired position. The stop 106 is then secured against the skate 102 in the new position by tightening the screw 108.

Various changes and modifications and equivalents of the embodiments described and shown in the drawings may be made within the scope of this invention. For example, in the first embodiment, the type of interlock system between the brake bracket 18 and chassis 24 may be different. Also, this arrangement may be adopted for use with roller skates, and not only in-line skates as depicted. Finally, it is an easy modification to combine the brake bracket and brake pad so that the whole assembly is replaced when the pad, or surface engaging portion, wear out. Having a single assembly would eliminate the need for the attachment screw as shown in the preferred embodiment. The second embodiment may be assembled without the use of the protrusion 112, although it adds strength to the brake. Also, ribs may be extended from the skate in facing relation with the stop 106 to eliminate the need for the channel 114/protrusion 112 arrangement. Thus, it is intended that all matters contained in the above description or shown in the accompanying drawings are presented by way of example only and are intended to be interpreted in an illustrative and not limiting sense.

What is claimed is:

1. An adjustable brake assembly for a shoe skate, comprising:

a brake pad;

means mounting said brake pad on said shoe skate, and means for adjusting the position of said brake pad relative to said shoe skate; and wherein said means for adjusting the position of said pad includes means for guiding said pad over a selected path having one end thereof closer to the supporting surface for said skate than the other, a screw threaded through said mounting means with said skate; and a slot forming said means for guiding perpendicular to said screw through which said screw passes.

2. The adjustable brake assembly as set forth in claim 1, wherein said slot is defined by a flange forming a mounting and sliding surface for said pad.

3. The adjustable brake assembly as set forth in claim 2 wherein loosening of said screw permits movement of said pad in a direction perpendicular to the length of said screw.

4. An adjustable brake assembly for a roller skate having wheels for rolling over a riding surface, comprising:

a brake pad;

means for mounting said pad on a skate chassis surface for movement of said pad at an acute angle to the riding surface; and means for selectively locking said pad at a plurality of desired heights above said riding surface and at a constant distance from said skate chassis surface when said pad is locked at any of the desired heights.

5. The adjustable brake assembly as set forth in claim 4, wherein said means for moving said pad is limited to movement in a straight line.

6. The adjustable brake assembly as set forth in claim 5; wherein said pad is located in a toe region of the skate.

7. The adjustable skate assembly as set forth in claim 4, wherein said means for mounting and means for selectively locking said pad include a screw having a cap and a protrusion extending from the skate.

* * * * *